US005280899A

United States Patent [19]

Kida et al.

[11] Patent Number: 5,280,899

[45] Date of Patent: Jan. 25, 1994

[54] AUTOMATIC DOCUMENT FEEDER

[75] Inventors: Yasuhiko Kida; Tsuyoshi Nagao; Masayuki Kakuta, all of Osaka, Japan

[73] Assignee: Mita Industrial Co., Ltd., Japan

[21] Appl. No.: 1,764

[22] Filed: Jan. 7, 1993

[30] Foreign Application Priority Data

Jan. 16, 1992 [JP] Japan ..... 4-026202

[51] Int. Cl.[5] ..... B65H 5/00

[52] U.S. Cl. ..... 271/10; 271/265; 271/227; 271/242

[58] Field of Search ..... 271/4, 6, 10, 265, 227, 271/242

[56] References Cited

U.S. PATENT DOCUMENTS

| | | | |
|---|---|---|---|
| 4,548,394 | 10/1985 | Koyama et al. | 271/242 X |
| 4,974,827 | 12/1990 | Arai et al. | 271/265 |
| 5,112,038 | 5/1992 | Dunaway | 271/265 X |
| 5,118,089 | 6/1992 | Yamada et al. | 271/265 X |
| 5,222,728 | 6/1993 | Takahashi | 271/242 |

FOREIGN PATENT DOCUMENTS

| | | | |
|---|---|---|---|
| 3061239 | 3/1991 | Japan | 271/10 |

*Primary Examiner*—H. Grant Skaggs
*Assistant Examiner*—Carol L. Druzbick
*Attorney, Agent, or Firm*—Beveridge, DeGrandi, Weilacher & Young

[57] ABSTRACT

In a primary paper feeding device, a document is conveyed from a document stock section to a pair of registration rollers by a first conveying device. The document conveyed to the registration rollers is further conveyed forward in a downstream direction by the registration rollers. When the lead (downstream) edge of the document arrives at a predetermined first reference position downstream of the registration rollers, document conveying by the registration rollers terminates. In this way, the document is conveyed such that the trailing edge thereof does not pass through the registration rollers. Thereafter, when a document change signal occurs, the registration rollers again are driven so that the document advances toward a position for document reading.

4 Claims, 8 Drawing Sheets

AUTOMATIC DOCUMENT FEEDER

BACKGROUND OF THE INVENTION

1. Field of the Invention

The present invention relates to an automatic document feeder used in an image forming apparatus such as a copying machine.

2. Description of the Prior Art

FIG. 8 shows the construction of a paper feeding section of an automatic document feeder used in a copying machine. The paper feeding section of the automatic document feeder comprises a paper feeding roller 100, a pair of paper separation rollers 101 and 102, and a pair of registration rollers 103 and 104. The paper feeding roller 100, the pair of paper separation rollers 101 and 102, and the pair of registration rollers 103 and 104 are driven by a paper feeding motor (not shown). The pair of paper separation rollers 101 and 102 comprises a forward roller 102 rotated in the direction in which documents are fed and a reverse roller 101 rotated in the opposite direction to the direction in which documents are fed as well known, to prevent the documents from being fed with their being overlapped with each other.

The rotating force of the paper feeding motor is transmitted to the paper feeding roller 100 and the pair of paper separation rollers 101 and 102 through a paper feeding clutch. The rotating force of the paper feeding motor is transmitted to one of the pair of registration rollers 103 and 104 through a registration clutch.

When a print key is activated so that a start signal from a main control section of the copying machine is sent to a control section of the automatic document feeder, the paper feeding motor is driven, so that the paper feeding roller 100 and the pair of paper separation rollers 101 and 102 are driven for a constant time period (primary paper feeding). A document P is usually fed toward the pair of registration rollers 103 and 104 by the primary paper feeding, and the front end of the document abuts on the pair of registration rollers 103 and 104, so that a loop is formed in the front end of the document.

Thereafter, when a document change signal from the main control section of the copying machine is sent to the control section of the automatic document feeder, the paper feeding roller 100, the pair of paper separation rollers 101 and 102, and the pair of registration rollers 103 and 104 are driven for a constant time period (secondary paper feeding). The document P is fed to a delivery belt provided ahead of the pair of registration rollers 103 and 104 in the direction in which documents are conveyed by the secondary paper feeding, to be set in the position for document reading on a transparent platen in the main body of the copying machine by the delivery belt.

When the document is set in the position for document reading, a print signal is sent to the main control section of the copying machine from the control section of the automatic document feeder, to report that a copying operation is possible.

After the primary paper feeding, the front end of the document is usually nipped between the pair of registration rollers 103 and 104. Even after the primary paper feeding, however, the front end of the document may not, in some cases, be nipped between the pair of registration rollers 103 and 104 depending on, for example, the type of print stack used. Thus, the lead edge of the document may not, in some cases, be nipped between the pair of registration rollers 103 and 104 even after the primary paper feeding. In the secondary paper feeding, therefore, not only the pair of registration rollers 103 and 104 but also the pair of paper separation rollers 101 and 102 is driven.

After the primary paper feeding, there occurs the difference in time required to move the document to the position for document reading in the secondary paper feeding depending on a case where the front end of the document is nipped between the pair of registration rollers 103 and 104 or a case where the front end of the document is not nipped between the pair of registration rollers 103 and 104. Specifically, a time period elapsed from the time when the control section of the automatic document feeder accepts the document change signal until it outputs the print signal (a time period required to change documents) varies.

In the conventional automatic document feeder, the time period required to change documents thus varies. Accordingly, an interval at which recording paper is conveyed to the position for transfer must be made relatively longer in view of the variation in the time period required to change documents. Therefore, the variation in the time period required to change documents is a factor which prevents the copy speed from being increased.

An object of the present invention is to provide an automatic document feeder capable of avoiding the variation in a time period required to change documents and increasing the copy speed.

SUMMARY OF THE INVENTION

An automatic document feeder according to the present invention comprises primary paper feeding means for conveying a document from a document stock section to a predetermined wait position and causing the document conveyed to wait and secondary paper feeding means for conveying the document waiting in the wait position to a predetermined position for document reading when a document change signal is received. The primary paper feeding means comprises first conveying means for feeding the document from the document stock section forward in the direction in which documents are conveyed i.e. downstream, a pair of registration rollers provided downstream of the first conveying means for conveying the document downstream, means for conveying the document from the document stock section to the pair of registration rollers by the first conveying means, means for conveying the document conveyed to the pair of registration rollers downstream by the pair of registration rollers, and means for stopping a document conveying operation performed by the pair of registration rollers when the front end of the document in the direction in which documents are conveyed to a predetermined first reference position downstream of the pair of registration rollers.

The first conveying means comprises, for example, a paper feeding roller for feeding the document from the document stock section downstream and a pair of paper separation rollers provided ahead of the paper feeding roller.

The secondary paper feeding means comprises, for example, second conveying means provided ahead of the pair of registration rollers, means for downstream conveyance of the document waiting in the wait position by the primary paper feeding means by the pair of registration rollers and the second conveying means when the document change signal is received, and means for stopping the conveyance by the second conveying means when recording paper is conveyed by a predetermined amount of feeding after the of the document passes through a predetermined second reference position downstream of the pair of registration rollers. A delivery belt, for example, is used as the second conveying means.

In the primary paper feeding means, the document stocked in the document stock section is conveyed to the pair of registration rollers by the first conveying means. The document conveyed to the pair of registration rollers is conveyed downstream by the pair of registration rollers. When the lead edge of the document reaches a predetermined first reference position ahead of the pair of registration rollers, a document conveying operation performed by the pair of registration rollers is stopped. Consequently, the document is conveyed until the lead edge of the document reaches to a predetermined position downstream of the pair of registration rollers and is caused to wait in a range in which the trailing edge of the document does not pass completely through the pair of registration rollers. Thereafter, when a document change signal is received, the pair of registration rollers is driven, so that the document in a wait state is conveyed toward the position for document reading.

When the document change signal is received, the front end of the document in the direction in which documents are conveyed is in a predetermined position ahead of the pair of registration rollers in the direction in which documents are conveyed, and the document is in a state where it is interposed between the pair of registration rollers. Accordingly, when the pair of registration rollers is driven on the basis of the acceptance of the document change signal, the document is reliably sent from the predetermined position. Consequently, a time period elapsed from the time when the document change signal is accepted until the document is set in the position for document reading, that is, a time period required to change documents is stabilized. Since the time period required to change documents is stabilized, it is possible to increase the copy speed. In addition, it is possible to reduce inferior secondary paper feeding.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
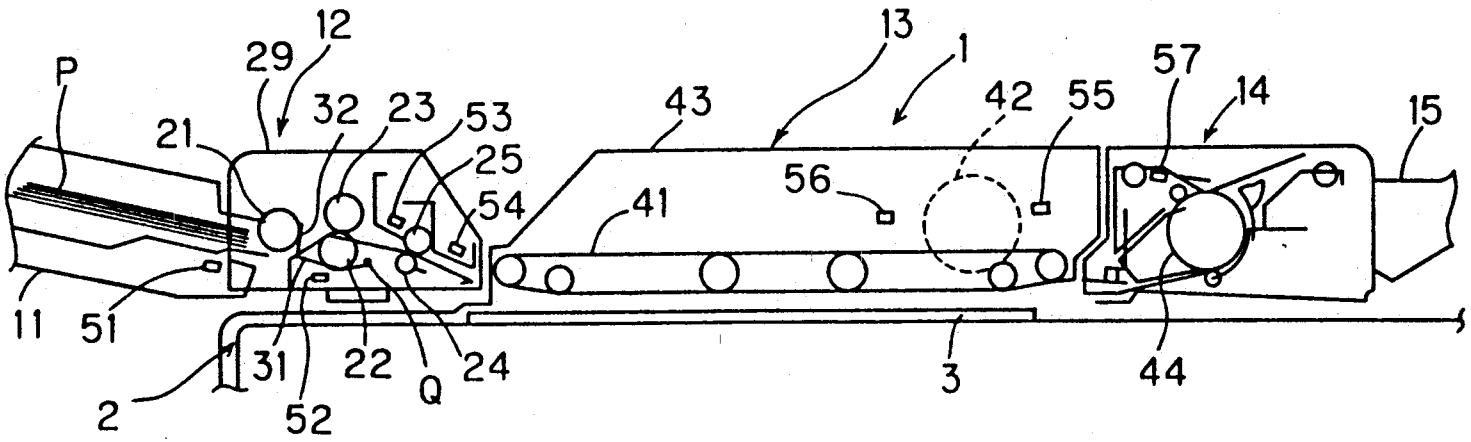
FIG. 1 is a diagram showing the construction of an automatic document feeder.

Referring now to the drawings, description is made of a case where the present invention is applied to an automatic document feeder used in a copying machine.

FIG. 1 shows the construction of an automatic document feeder.

An automatic document feeder 1 is placed on the upper surface of the main body of a copying machine 2. The automatic document feeder 1 comprises a paper feeding section 12 for accepting documents P on a document platen 11, a conveying section 13 for conveying the document fed from the paper feeding section 12 to a predetermined position for reading on a transparent platen 3 in the main body of the copying machine 2, and a discharge section 14 for discharging the document whose reading is terminated. In this automatic document feeder 1, the documents P are mounted on the document platen 11 in a state where the surfaces thereof are directed downward and sequentially fed in descending order.

The paper feeding section 12 comprises a paper feeding roller 21, a pair of paper separation rollers 22 and 23, and a pair of registration rollers 24 and 25. The paper feeding roller 21, the pair of paper separation rollers 22 and 23, and the pair of registration rollers 24 and 25 are driven by a paper feeding motor 26 which is not shown in FIG. 1 (see FIG. 2). The paper feeding roller 21 is provided movably up and down. The paper feeding roller 21 is in its lower position, as shown in FIG. 1, at the time of paper feeding. The pair of paper separation rollers 22 and 23 comprises a forward roller 23 rotated in the direction in which documents are fed and a reverse roller 22 rotated in the opposite direction to the direction in which documents are fed as well known, to prevent the documents being fed in an overlapped state.

Figure 2:
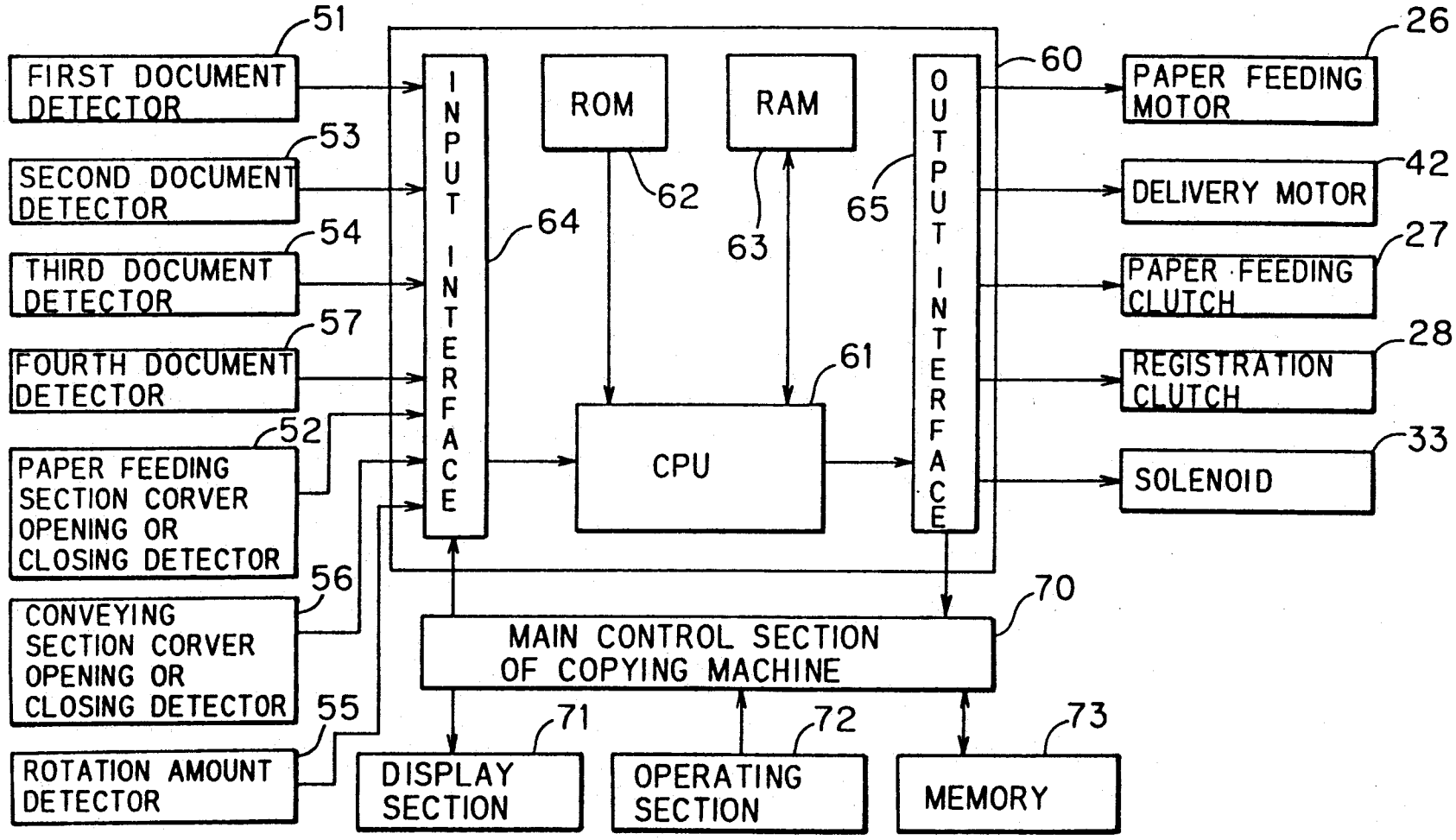
FIG. 2 is a block diagram showing the electrical construction of the automatic document feeder and the main body of a copying machine.

The rotating force of the paper feeding motor 26 is transmitted to the paper feeding roller 21 and the pair of paper separation rollers 22 and 23 through a paper feeding clutch 27 which is not shown in FIG. 1 (see FIG. 2). The rotating force of the paper feeding motor 26 is transmitted to one of the pair of registration rollers 24 and 25 through a registration clutch 28 which is not shown in FIG. 1 (see FIG. 2).

Furthermore, the paper feeding section 12 is provided with a document stopper 31 having an L shape in cross section for positioning, when documents are set on the document platen 11, the front ends of the documents in the direction in which documents are conveyed. The document stopper 31 is provided swingably around its one end Q. The document stopper 31 is always held by an urging force of a spring (not shown) such that it is in the position where a positioning plate section 32 on the side of its swing end blocks a document conveying path between the paper feeding roller 21 and the pair of paper separation rollers 22 and 23, as shown in FIG. 1. The position of the document stopper 31 in this state is referred to as a position for positioning the front ends of documents hereinafter. At the time of feeding documents, a solenoid 33 which is not shown in FIG. 1 (see FIG. 2) is driven, whereby the document stopper 31 is caused to swing and held until the positioning plate section 32 is in the lower position of the document conveying path between the paper feeding roller 21 and the pair of paper separation rollers 22 and 23.

The position of the document stopper 31 in this state is referred to as a position for feeding documents hereinafter.

The paper feeding roller 21 is supported movably up and down. When documents are set on the document platen 11, the paper feeding roller 21 is in a position above the position shown in FIG. 1. When the document is mounted on the document platen 11, the leading edge of the document abuts the positioning plate section 32 of the document stopper 31. At the time of feeding documents, the paper feeding roller 21 is moved to such a position that paper feeding is possible, as shown in FIG. 1.

A first document detector 51 for detecting the document on the document platen 11 is provided in the front end of the document platen 11. The paper feeding section 12 is provided with a paper feeding section cover opening or closing detector 52 for detecting the opened or closed state of a paper feeding section cover 29. In addition, second and third document detectors 53 and 54 are provided behind and ahead of the pair of registration rollers 24 and 25 in the direction in which documents are conveyed.

The conveying section 13 comprises a delivery belt 41 for conveying the document fed from the paper feeding section 12 to the position for reading on the transparent platen 3 in the copying machine 2 as well as conveying the document in the position for reading to the document discharge section 14. The delivery belt 41 is run and driven by a delivery motor 42. The document conveying section 13 is provided with a rotation amount detector 55 for detecting the amount of rotation of the delivery motor 42 and a conveying section cover opening or closing detector 56 for detecting the opened or closed state of a conveying section cover 43. The rotation amount detector 55 outputs pulses every time the delivery motor 42 is rotated through a predetermined angle.

The discharge section 14 comprises a discharge roller 44 for feeding the document fed from the conveying section 13 to a discharge tray 15. The discharge roller 44 is driven by the delivery motor 42. The discharge section 14 is provided with a fourth document detector 57.

FIG. 2 shows the electrical construction of an automatic document feeder and the main body of a copying machine.

An automatic document feeder 1 is controlled by a control section of the feeding device 60. The control section of the feeding device 60 comprises a CPU 61, a ROM 62 storing its program, a RAM 63 storing necessary data, an input interface 64, and an output interface 65.

A first document detector 51, a second document detector 53, a third document detector 54, a fourth document detector 57, a paper feeding section cover opening or closing detector 52, a conveying section cover opening or closing detector 56, and a rotation amount detector 55 are connected to the CPU 61 through the input interface 64. A paper feeding motor 26, a delivery motor 42, a paper feeding clutch 27, a registration clutch 28, and a solenoid 33 are connected to the CPU 61 through the output interface 65.

Furthermore, a main control section of the copying machine 70 is connected to the CPU 61 through the input interface 64 and the output interface 65. A display section 71, an operating section 72 having a print key 72 and the like, and a memory 73 are connected to the main control section of the copying machine 70.

Figure 3:
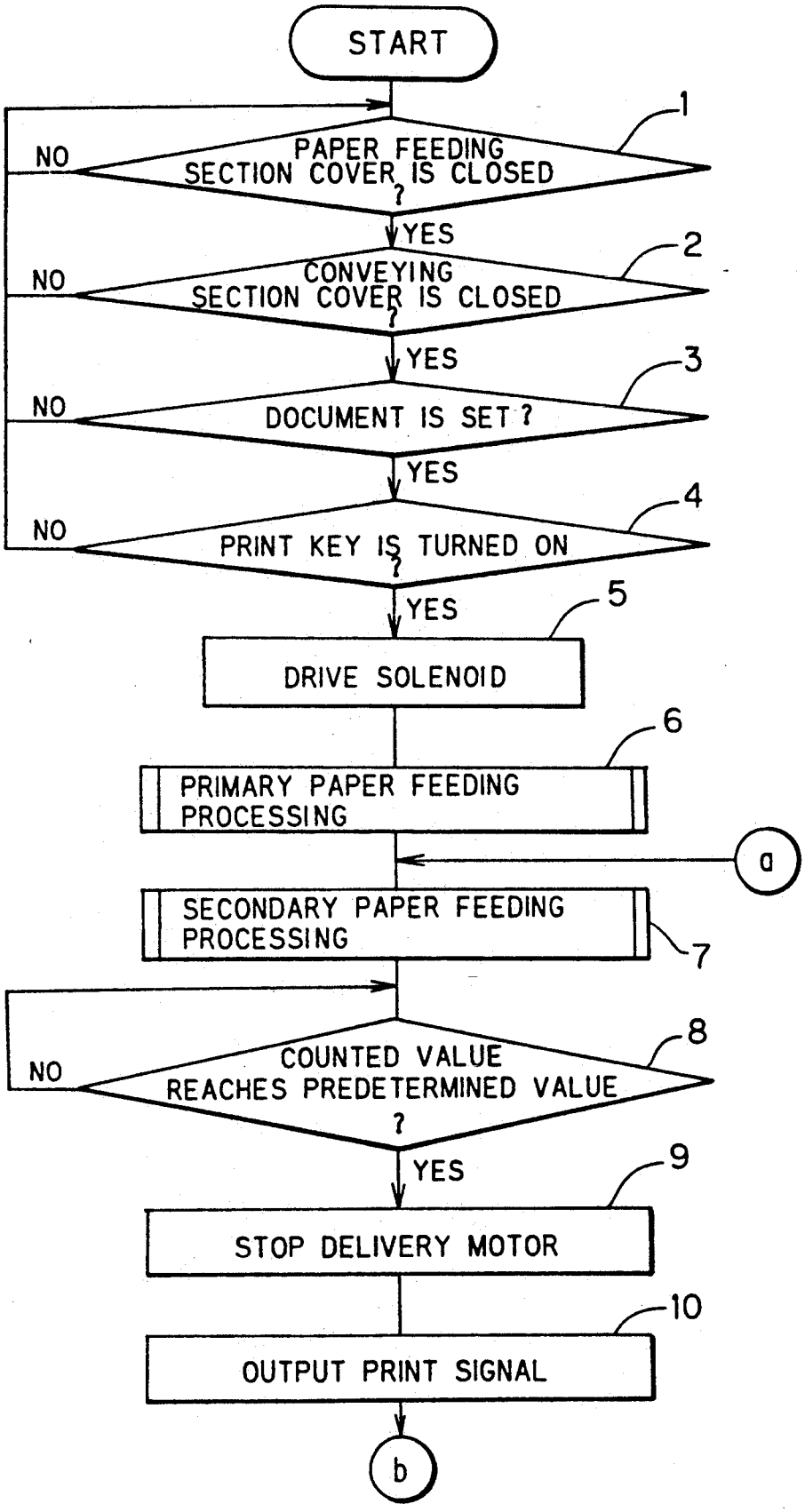
FIGS. 3 and 4 are flow charts showing the procedure for automatic document feeding processing performed by a CPU.
Figure 4:
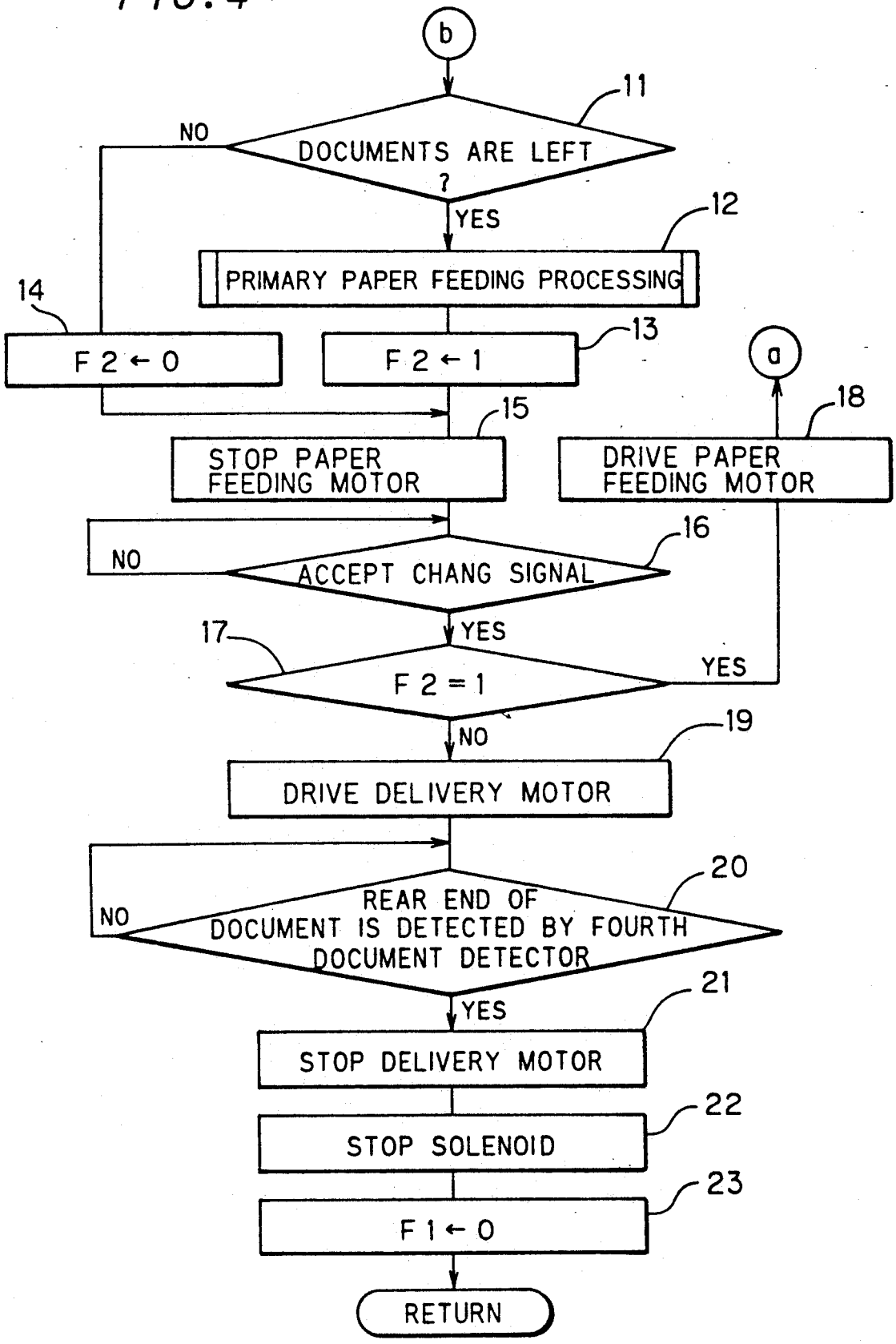

FIGS. 3 and 4 show the procedure for automatic document feeding processing performed by the CPU 61.

It is determined whether or not the paper feeding section cover 29 is closed (step 1), the conveying section cover 43 is closed (step 2) and the documents are set on the document platen 11 (step 3), respectively, on the basis of the paper feeding section cover opening or closing detector 52, the conveying section cover opening or closing detector 56 and the first document detector 51. In a case where the paper feeding section cover 29 and the conveying section cover 43 are closed and the documents are set on the document platen 11, if the print key of the operating section 72 in the main body of the copying machine is activated (step 4), the solenoid 33 is driven, so that the document stopper 31 is caused to swing to be moved to the position for feeding documents and held (step 5).

Figure 5:
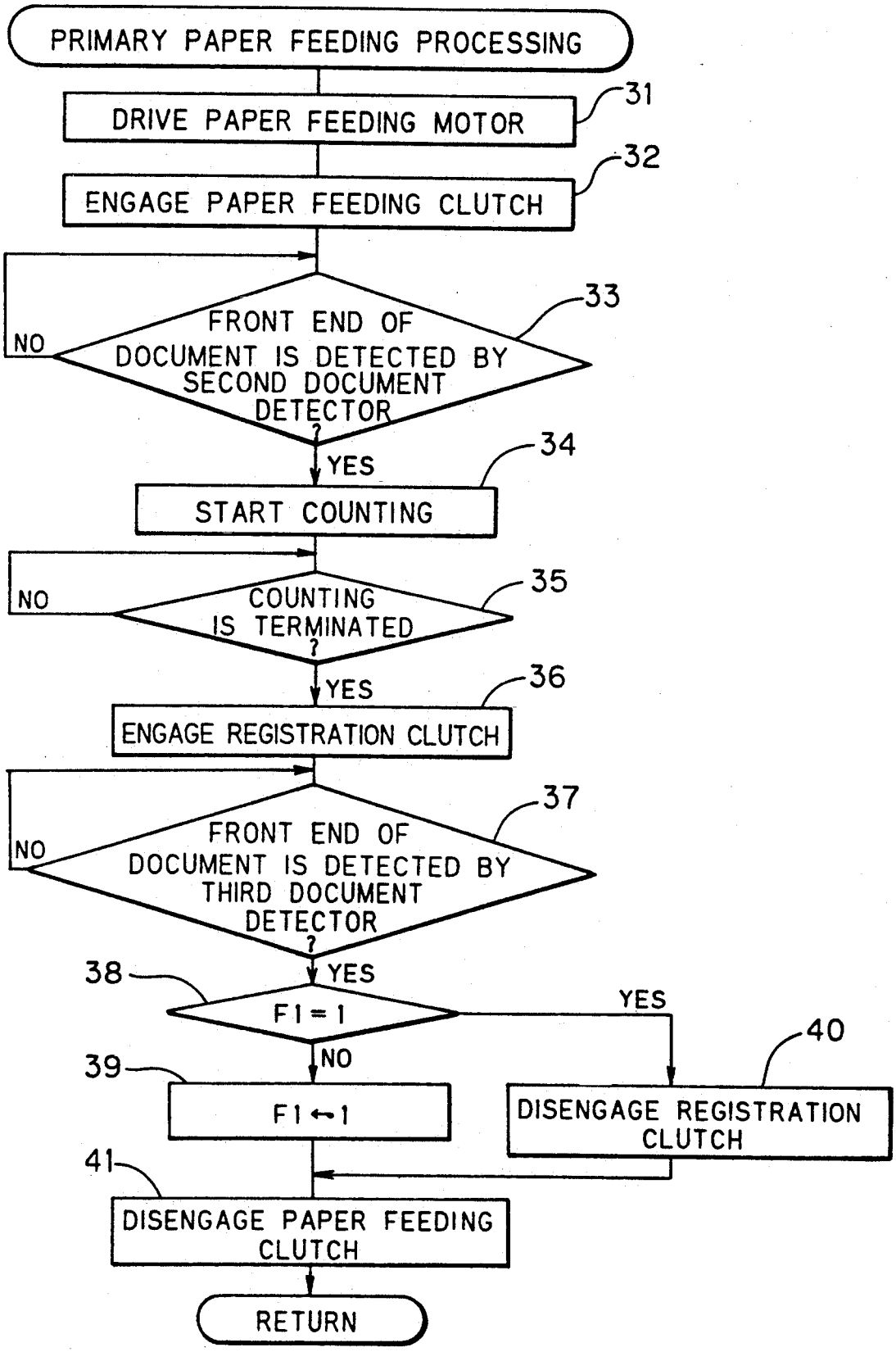
FIG. 5 is a flow chart showing the procedure for primary paper feeding processing.

Primary paper feeding processing is executed (step 6). In the primary paper feeding processing, the paper feeding motor 26 is first driven and the paper feeding clutch 27 is engaged, as shown in FIG. 5 (steps 31 and 32), so that the paper feeding roller 21 and the pair of paper separation rollers 22 and 23 are driven. Consequently, the uppermost document mounted on the document platen 11, without there being an overlap, is accepted in the paper feeding section 12.

When the leading edge of the document is detected by the second document detector 53 upstream of the pair of registration rollers 24 and 25 (step 33), counting of a predetermined time period is started (step 34). This predetermined time period is set to a time period suited for the leading edge of the document to abut on the pair of registration rollers 24 and 25 to form a suitable loop after the front end of the document is detected by the second document detector 53. When the above described predetermined time period has elapsed (step 35), the registration clutch 28 is engaged (step 36), so that the pair of registration rollers 24 and 25 is driven.

When the leading edge of the document is detected by the third document detector 54 downstream of the pair of registration rollers 24 and 25 (step 37), it is judged whether or not a first flag F1 is set (step 38). The first flag F1 is used for indicating whether or not the document subjected to the primary paper feeding is the first document out of the documents set on the document platen 11 and is reset in initialization after the application of the power supply.

In the primary paper feeding processing in the step 6, therefore, the first flag F1 is in a reset state (F1=0). Accordingly, the program proceeds to the step 39. In step 39, the first flag F1 is set (F1=1) and then, the paper feeding clutch 27 is disengaged (step 41). Consequently, the primary paper feeding processing of the first document is terminated. Since the document is the first document, the registration clutch 28 remains engaged even after the front end of the document is detected by the third document detector 54, so that the document is conveyed to the conveying section 13.

Figure 6:
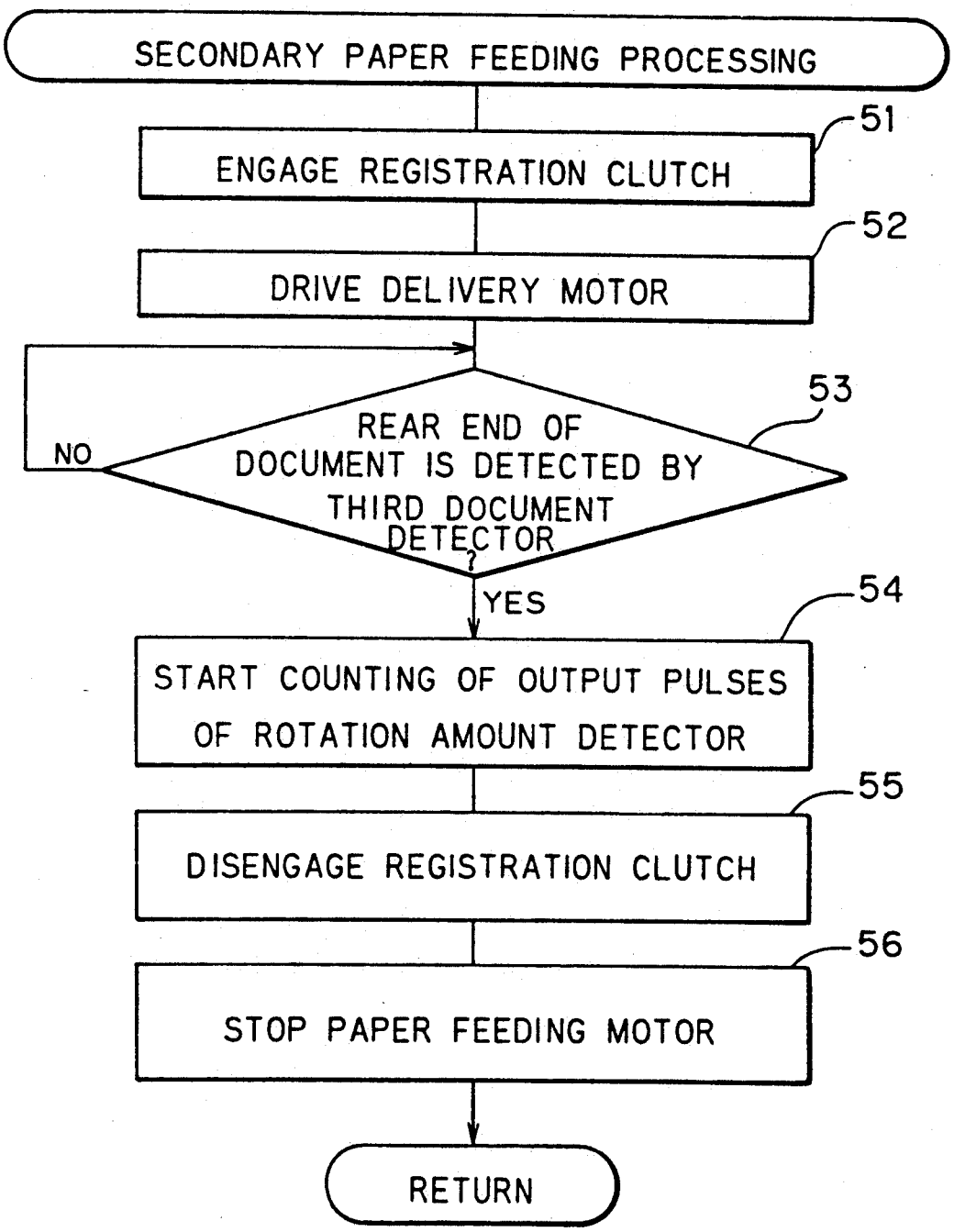
FIG. 6 is a flow chart showing the procedure for secondary paper feeding processing.

When the primary paper feeding processing of the first document is terminated, secondary paper feeding processing is executed (step 7). In the secondary paper feeding processing, the registration clutch 28 is first engaged and the delivery motor 42 is driven, as shown in FIG. 6 (steps 51 and 52). Consequently, the pair of registration rollers 24 and 25 is driven and the delivery belt 41 is run and driven. As described above, in the primary paper feeding processing in the step 6, the registration clutch 28 remains engaged. Accordingly, in secondary paper feeding processing performed subsequently to the step 6, the pair of registration rollers 24 and 25 is driven from the beginning.

The document is conveyed to the conveying section 13 by the pair of registration rollers 24 and 25, and the document is conveyed toward a predetermined position for reading on the transparent platen 3 by the delivery belt 41. When the trailing edge of the document is detected by the third document detector 54 (step 53), the counting of the number of output pulses of the rotation amount detector 55 is started so as to position the document in the position for reading on the transparent platen 3 (step 54). In addition, the registration clutch 28 is disengaged and the driving of the paper feeding motor 26 is stopped (steps 55 and 56), so that the secondary paper feeding processing performed this time is terminated.

When the counted value of the number of output pulses of the rotation amount detector 55 reaches a predetermined value after the secondary paper feeding processing is terminated (step 8), the driving of the delivery motor 42 is stopped (step 9). Consequently, the document is positioned on the position for reading on the transparent platen 3. Furthermore, in order to report to the main control section of the copying machine 70 that the document is set on the position for reading, a print signal is sent to the main control section of the copying machine 70 (step 10). The main control section of the copying machine 70 starts exposure processing on the basis of this print signal.

After the print signal is generated, it is determined whether or not the documents are left on the document platen 11 on the basis of the first document detector 51 (step 11). If the documents are left, primary paper feeding processing as shown in FIG. 5 is executed again so as to feed the subsequent document (step 12). In primary paper feeding processing of the second document and the subsequent documents, the first flag F1 has been already set (F1=1), whereby the answer is in the affirmative in the step 38. Consequently, when the front end of the document is detected by the third document detector 54 in the step 37, the program proceeds to the step 40 from the step 38, so that the registration clutch 28 is disengaged so as to time the change of documents read. Specifically, the document is brought into a wait state in a state where the leading edge of the document is in a predetermined position downstream of the pair of registration rollers 24 and 25 in the direction in which documents are conveyed. In this case, the document is interposed between the pair of registration rollers 24 and 25.

When this primary paper feeding processing is terminated, a second flag F2 is set (F2=1) (step 13), and the driving of the paper feeding motor 26 is stopped (step 15). Thereafter, when a document change signal is sent from the main control section of the copying machine 70 (step 16), it is determined whether the second flag F2 is set or reset (step 17). If the second flag F2 is set, it is judged that the document fed by the primary paper feeding is in a wait state, so that the paper feeding motor 26 is driven (step 18).

The program then proceeds to the step 7. In the step 7, secondary paper feeding processing shown in FIG. 6 is executed again. In secondary paper feeding processing of the second document and the subsequent documents, the pair of registration rollers 24 and 25 and the delivery belt 41 are driven, whereby the document waiting in the paper feeding section 12 is conveyed toward the position for reading and at the same time, the document whose reading has been already terminated is sent to the discharge section 14. The document sent to the discharge section 14 is discharged onto the discharge tray 15 by the discharge roller 44. When the secondary paper feeding processing is terminated, so that the counted value of the number of output pulses of the rotation amount detector 55 reaches a predetermined value (step 8), the driving of the delivery motor 42 is stopped (step 9), and the print signal is sent to the main control section of the copying machine 70 (step 10).

When all the documents set on the document platen 11 are thus subjected to primary and secondary paper feeding, no documents are detected by the first document detector 51. Therefore, in the step 11, it is judged that no documents are left on the document platen 11. In this case, the program proceeds to the step 14 from the step 11. In the step 14, the second flag F2 is reset (F2=0). The driving of the paper feeding motor 26 is stopped (step 15).

Thereafter, when the document change signal is sent from the main control section of the copying machine 70 (step 16), the state of the second flag F2 is judged (step 17). Since the second flag F2 is in a reset sate, the program proceeds to the step 19 from the step 17. In the step 19, the delivery motor 42 is driven so as to discharge the last document in the position for reading. When the rear end of the last document is detected by the fourth document detector 57 (step 20), the driving of the delivery motor 42 is stopped (step 21). In addition, the driving of the solenoid 33 is stopped (step 22). Consequently, the document stopper 31 is caused to swing to be moved to the position for positioning of the front ends of documents and held. In addition, the first flag F1 is reset (step 23), so that the automatic document feeding processing performed this time is terminated.

Figure 7:
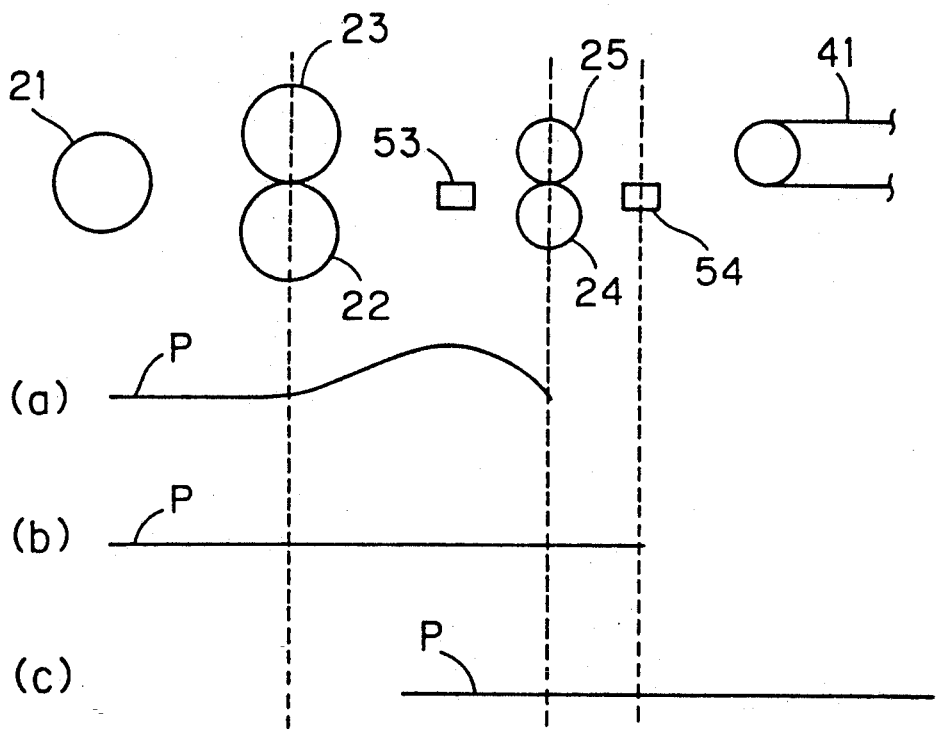
FIG. 7 is a diagram for explaining a paper feeding operation of the second document and the subsequent documents.
Figure 8:
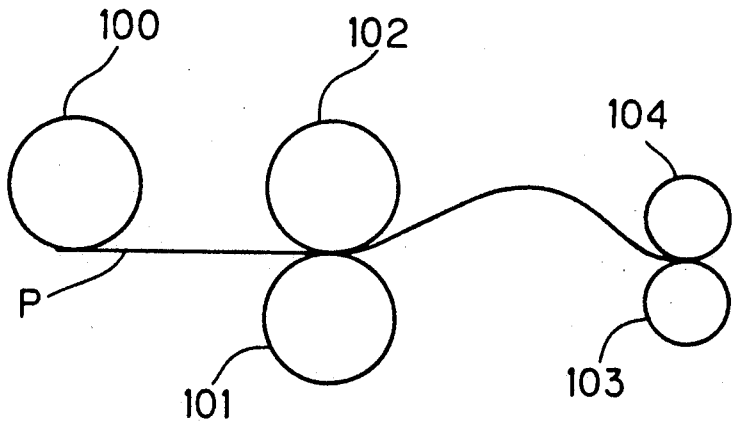
FIG. 8 (PRIOR ART)
FIG. 8 is a diagram for explaining a conventional paper feeding operation.

In the above described embodiment, in the primary paper feeding processing of the second document and the subsequent documents, the document is sent in the following manner. The pair of paper separation rollers 22 and 23 is driven in a state where the pair of registration rollers 24 and 25 is stopped (steps 31 to 35 in the primary paper feeding processing), whereby the front end of a document P abuts on the pair of registration rollers 24 and 25, so that a suitable loop is formed in the front end of the document P, as shown in FIG. 7(*a*). Thereafter, the pair of registration rollers 24 and 25 is driven (step 36 in the primary paper feeding processing), whereby the front end of the document P passes between the pair of registration rollers 24 and 25. When the front end of the document P is detected by the third document detector 54 (step 37 in the primary paper feeding processing), the pair of registration rollers 24 and 25 and the pair of paper separation rollers 22 and 23 are stopped (steps 39 and 40 in the primary paper feeding processing). Consequently, the leading edge of the document P is positioned in the position for detection by the third document detector 54, so that the document P is brought into a wait state in a state where it is interposed between the pair of registration rollers 24 and 25, as shown in FIG. 7(*b*). Thereafter, when the document change signal is sent, the secondary paper feeding processing is performed, so that the document is conveyed toward the position for reading, as shown in FIG. 7(*c*).

As described in the foregoing, according to the present embodiment, in a time period from the time when the previous document is set in the position for reading until the document change signal is accepted, the leading edge of the document P is in the position for detection by the third document detector 54, so that the document P is brought into a wait state in a state where it is interposed between the pair of registration rollers 24 and 25, as shown in FIG. 7(*b*). Consequently, a time period from the time when the document change signal is accepted until the document is set in the position for reading to output the print signal (a time period required to change documents) is stabilized, so that it is possible to increase the copy speed. Furthermore, it is possible to reduce inferior secondary paper feeding. Additionally, in the secondary paper feeding processing, the paper feeding clutch 27 need not be engaged at the time of starting the delivery motor, thus reducing the burden on the power supply at the time of starting the delivery motor.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An automatic document feeder comprising:

primary paper feeding means for conveying a document from a document stock section to a predetermined wait position where the document waits; and secondary paper feeding means for conveying the document in said wait position to a predetermined position for document reading in response to a document change signal generated to indicate termination of exposure processing for another document in said position for document reading;

said primary paper feeding means comprising a first conveying device for feeding the document from said document stock section in a downstream direction, a pair of registration rollers provided downstream of said first conveying device, a first control means for controlling conveying of a document from said document stock section to said pair of registration rollers by said first conveying device, a second control means for controlling further downstream conveying of said document, conveyed to said pair of registration rollers, by said registration rollers; and a third control means for stopping further downstream conveying of said document by said pair of registration rollers when a downstream edge of said document reaches a predetermined first reference position downstream of said pair of registration rollers.

2. The automatic document feeder according to claim 1, wherein said first conveying device comprises a paper feeding roller for feeding said document from said document stock section downstream, and a pair of paper separation rollers provided downstream of said paper feeding roller.

3. The automatic document feeder according to claim 1, wherein said second paper feeding means comprises a second conveying device provided downstream of said pair of registration rollers;

a further control means for controlling further downstream conveying of said document waiting in said wait position in response to said document change signal; and means for stopping conveyance by said second conveying device when said document is conveyed by a predetermined extent and said trailing edge of said document passes a predetermined second reference position downstream of said pair of registration rollers.

4. The automatic document feeder according to claim 3, wherein said second conveying device is a delivery belt.

* * * * *